US005950902A

United States Patent [19]

Moore, Sr.

[11] Patent Number: 5,950,902

[45] Date of Patent: Sep. 14, 1999

[54] CORNER BEAD FASTENING TOOL

[76] Inventor: George Carlton Moore, Sr., 10801 Nash Rd., Chesterfield, Va. 23838

[21] Appl. No.: 09/095,255

[22] Filed: Jun. 10, 1998

[51] Int. Cl.[6] ..... B25C 1/04

[52] U.S. Cl. ..... 227/130; 227/109; 227/148; 227/156

[58] Field of Search ..... 227/130, 148, 227/156, 30, 109, 110, 78

[56] References Cited

U.S. PATENT DOCUMENTS

| | | | |
|---|---|---|---|
| 4,127,226 | 11/1978 | Jasper | 227/148 |
| 4,288,016 | 9/1981 | Failla et al. | 227/30 |
| 4,574,452 | 3/1986 | Kennedy et al. | 227/148 |
| 4,989,438 | 2/1991 | Simon | 227/130 |
| 5,065,930 | 11/1991 | Kennedy | 227/130 |
| 5,524,807 | 6/1996 | Bullard | 227/130 |
| 5,667,126 | 9/1997 | Boucek | 227/130 |

*Primary Examiner*—Scott A. Smith

[57] ABSTRACT

A corner bead fastening tool comprising a pair of hinged faceplates, a pair of fastener guns each mounted on one of the faceplates with brackets, a handle mounted on the hinged faceplate assembly between the fastener guns, and a common trigger mechanism on the handle which permits simultaneous firing of both fastener guns.

7 Claims, 4 Drawing Sheets

CORNER BEAD FASTENING TOOL

FIELD OF THE INVENTION

The present invention relates to an improved tool for the attachment of outside corner bead in a dry-walling installation. More specifically, the improved tool of the present invention provides flexibility not possible with similar tools described in the prior art.

BACKGROUND OF THE INVENTION

In the installation of dry-wall one of the major time-consuming tasks is the attachment of the outside corner bead. Performed manually, this task requires holding the corner bead in place and nailing from two directions on either side of the bead. Under these circumstances, the bead is often misaligned with the corner resulting in the operation having to be repeated, if an acceptable corner is to result.

For this reason, a number of devices have been designed to simplify the attachment of corner bead. For example, U.S. Pat. No. 5,524,087 describes a handled fastener tool which includes first and second fastener guns supported by a handle, at a predetermined angle in relation to each other and the intersecting walls. The first and second fastener guns drive respective fasteners into the corner bead and are triggered by a single trigger mechanism that actuates both guns simultaneously.

Similarly, U.S. Pat. No. 5,667,126 describes a tool comprising a pair of fastener ejecting guns secured to a handle in parallel relationship and in a predetermined angular relationship with respect to one another and with the corner bead being attached. The tool includes a trigger assembly for simultaneously actuating the actuating levers of both guns.

While these patents describe useful tools for installing drywall bead, they fail to address a major problem often encountered with such installations, namely, that the corner to which the bead is being attached is not square due to irregularities in the underlying studding or simply shoddy carpentry. Even under the best of circumstances, individual outside corners within a given structure will vary in angular dimension even though they may be relatively uniform along their respective individual lengths. Thus devices as described in the prior art which place the pair of guns at a predetermined or fixed angle can provide an inferior installation by allowing the bead stand removed from the wall surface along its length as the shape of the corner changes therealong or from individual corner to individual corner.

The device of the present invention is, on the other hand, designed with a hinged structure that allows a pair of simultaneously activatable guns to rotate with respect to one another so to fit the shape of the outside corner to which the corner bead is being attached. The flexibility of the hinged design described herein allows use of the tool on corners that can vary quite significantly in their relative angular configuration.

SUMMARY OF THE INVENTION

The present invention provides a corner bead fastening tool comprising a pair of hinged faceplates, a pair of fastener guns each mounted on one of the face plates with brackets, a handle mounted on the hinged face plate assembly between the fastener guns, and a common trigger mechanism which permits simultaneous firing of both fastener guns. According to various preferred embodiments, which will be described in greater detail hereinafter, the corner bead fastening tool includes a manifold for conducting fluid which actuates both guns, apertures in the hinged faceplates through which the fastener firing portion, or barrel, of the fastener guns penetrate, adjustable set screws in the handle which allow the hinged face plates to be locked or placed in fixed angular relationship, and a recess at the inner apex of the hinge designed to engage the bulbous corner or nose of conventional corner bead during installation.

DETAILED DESCRIPTION OF THE INVENTION

Figure 1:
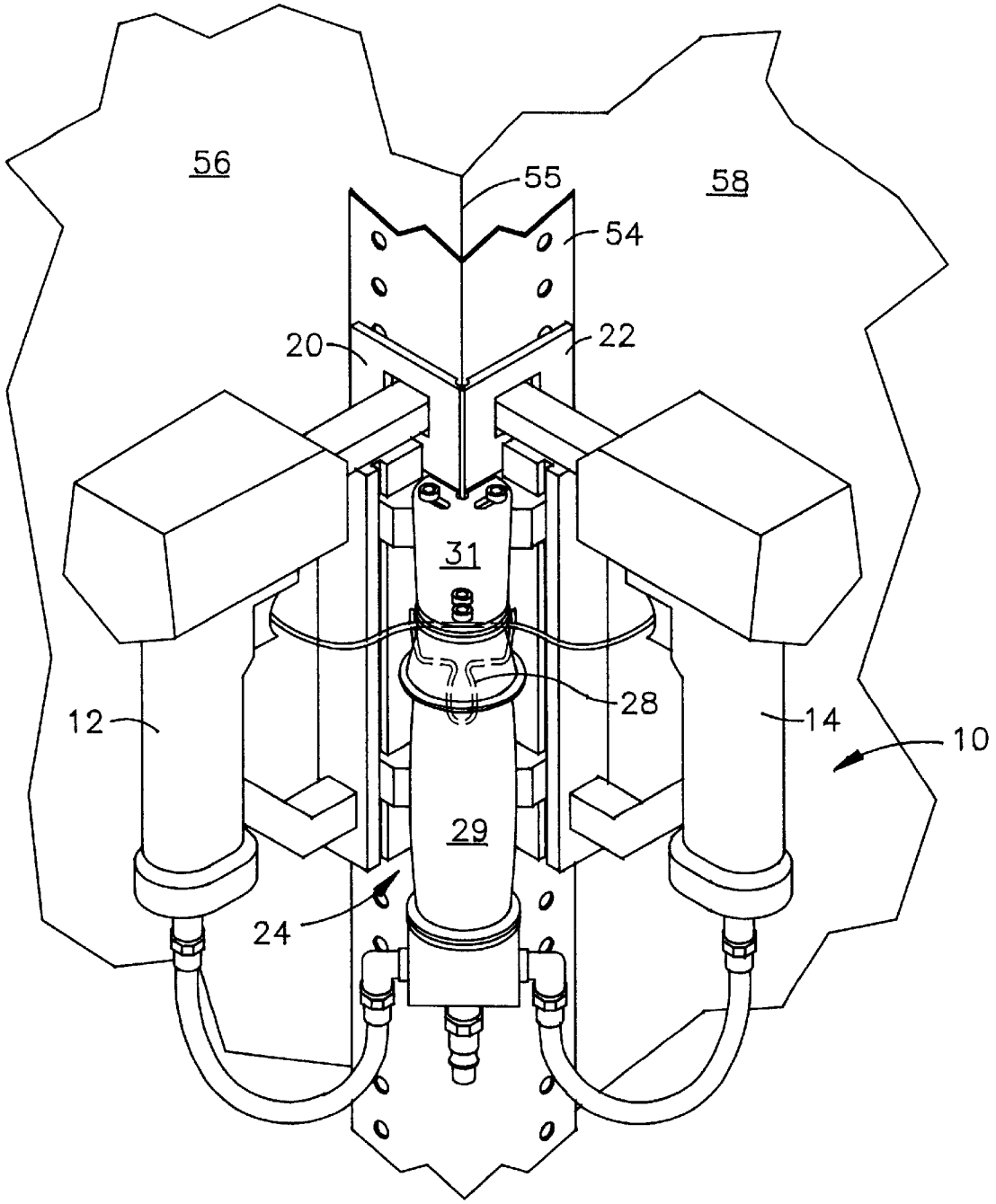
FIG. 1 is a perspective view of the dual bead fastener tool of the present invention as applied to attach corner bead to an outside wall corner.
Figure 2:
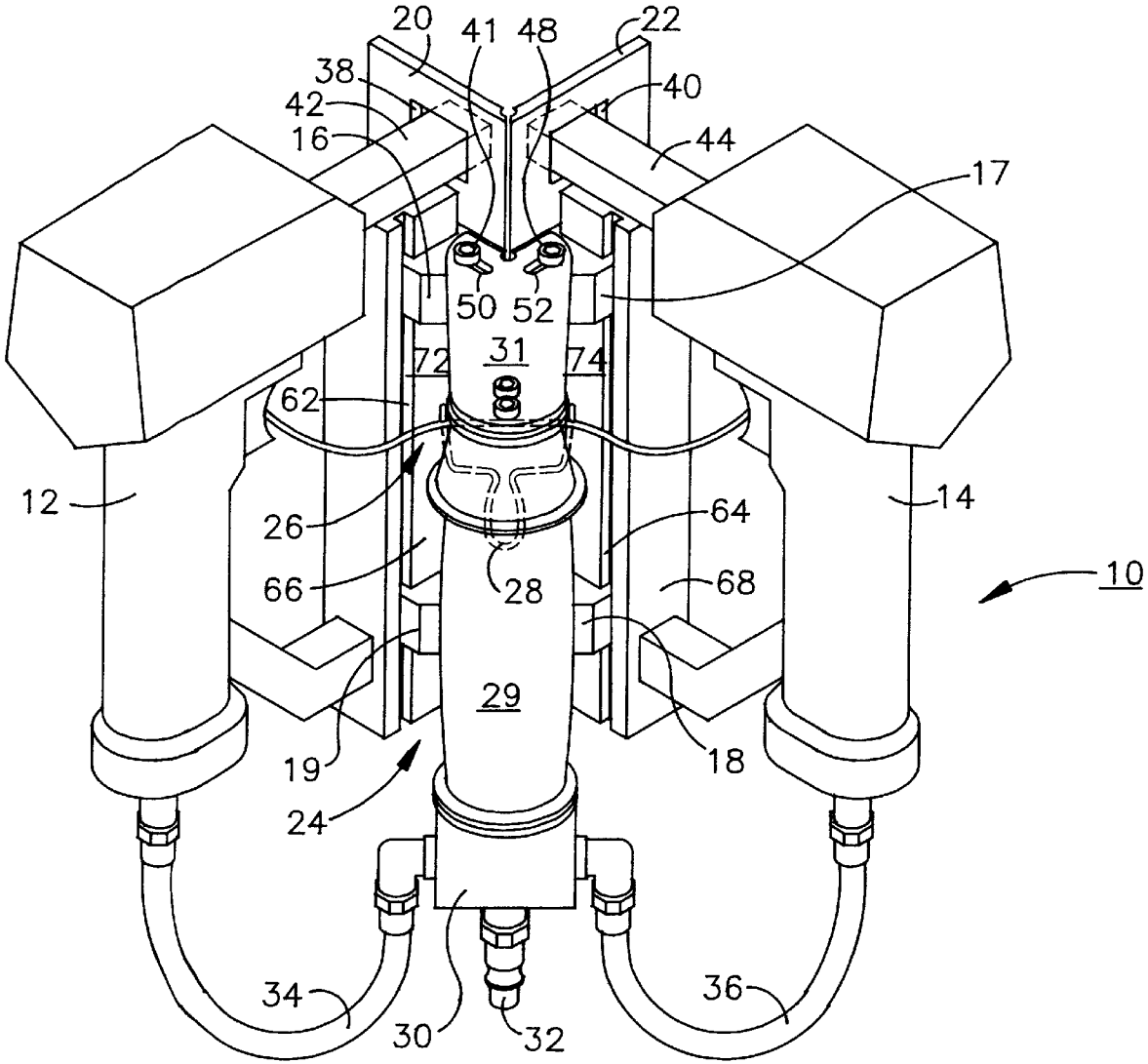
FIG. 2 is a perspective view of the fastener tool of the present invention.

As shown in FIG. 2, the fastening tool 10 of the present invention comprises a pair of fastener guns 12 and 14 mounted via brackets 16, 17, 18 and 19 to a pair of hinged faceplates 20 and 22. Handle 24 is likewise attached to hinged faceplates 20 and 22 via brackets 16 and 17 through the use of set screws 46 and 48 that engage slots 50 and 52 as shown in greater detail in FIG. 5. Trigger mechanism 26 provides the means for simultaneously firing fastener guns 12 and 14 by movement of trigger 28. In the preferred embodiment of the invention shown in FIG. 2 handle 24 is provided with a manifold 30 wherein activating fluid for guns 12 and 14 is admitted via inlet port 32 and equally distributed via conduits 34 and 36 to guns 12 and 14. Faceplates 20 and 22 are provided with apertures 38 and 40 to permit access of fastener delivery means or barrels 42 and 44 to the surface to be fastened as shown in greater detail in FIG. 1.

FIG. 1 depicts the fastening tool of the present invention as applied in use. In the depiction of FIG. 1, the fastening tool 10 is applied over corner bead 54 which in turn has been applied over outside corner 55 of intersecting pieces of dry wall 56 and 58. As is well known to those who install corner bead of this type, outside corner 55 is rarely at a perfect 90 degree angle. It is in such instances that the fastening tool of the present invention is particularly effective due to its ability to adjust to angles of from about 80 to about 120 degrees. In some instances, the angle of outside corner 55 is intentionally designed to be greater or less than 90 degrees and the fastening tool described herein is equally useful in such installations.

Figure 6:
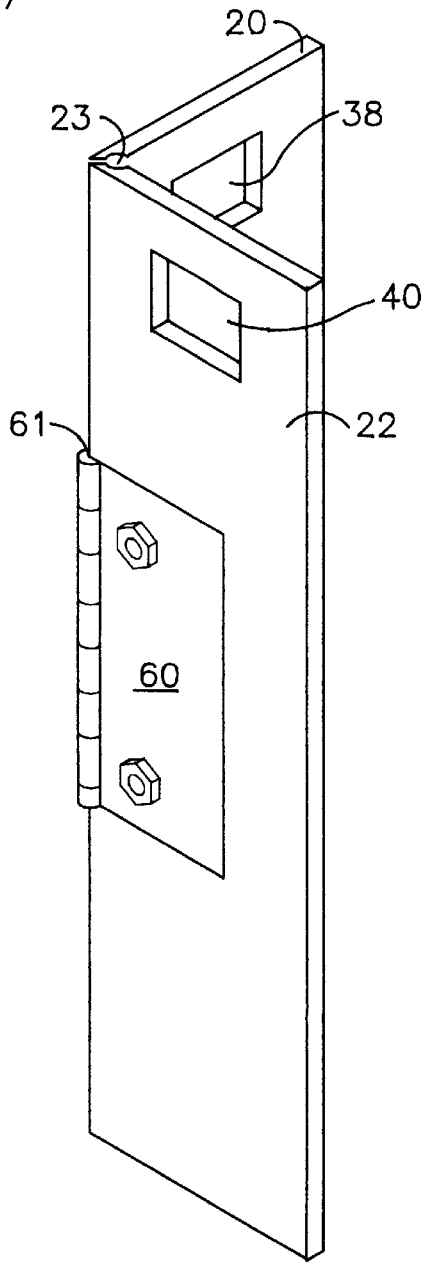
FIG. 6 is a perspective view of the hinge portion of the fastener tool of the present invention without the fastener guns or brackets attached.

It is the hinged arrangement of faceplates 20 and 22 shown in detail in FIG. 6 which provides the flexibility of the fastening tool of the present invention. As shown in FIG. 6, faceplate assembly 59 comprises faceplates 20 and 22 that are connected via a hinge 60. This arrangement permits face plates 20 and 22 to rotate with respect to each other about pivot point 61 and in a common plane. While hinge 60, is shown as a common door-type hinge which is preferred because of the durability and rigidity of such hinges, it is obvious that other hinge structures could be used. For example, faceplates 20 and 22 and hinge 60 could be fabricated from a single piece of polymeric, for example polypropylene, material such that the hinge was an integral flexing portion of the faceplate assembly. Such a structure would be equally useful and provide the requisite amount of flex, but would not be as durable as the common hinge structure depicted in FIG. 6.

Figure 4:
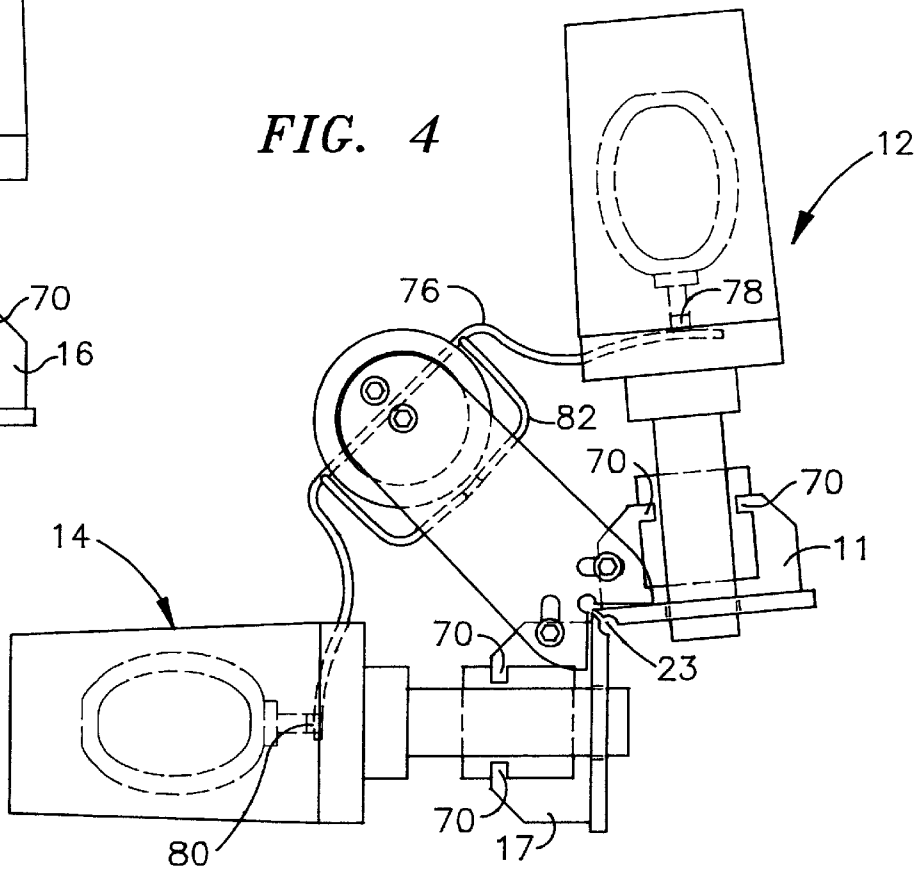
FIG. 4 is a top view of the fastener tool of the present invention as it appears preparatory to application to a corner having a 90 degree angle.
Figure 3:
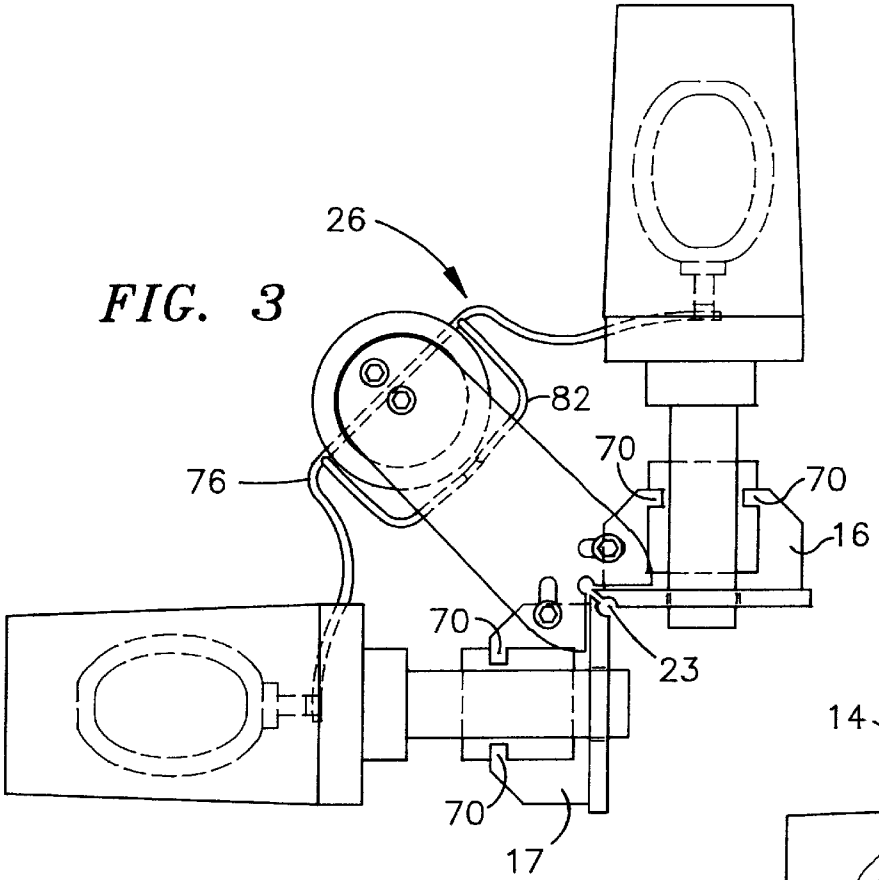
FIG. 3 is a top view of the fastener tool of the present invention as it appears preparatory to application to an angle greater than 90 degrees.
Figure 5:
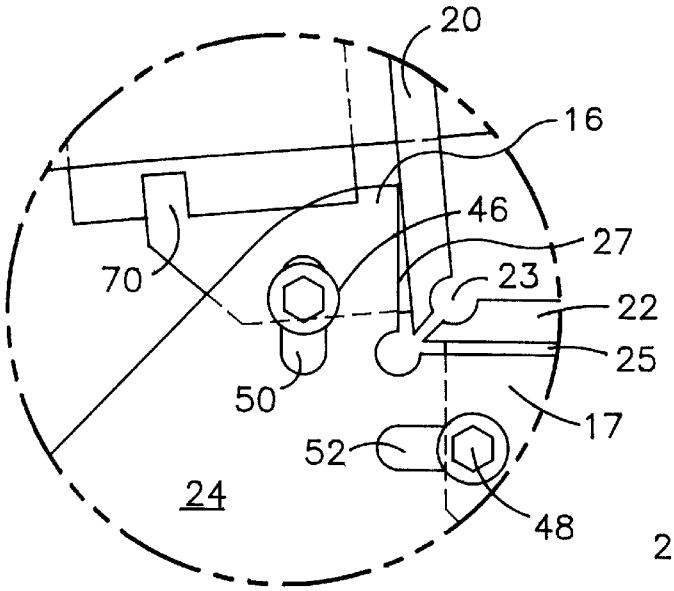
FIG. 5 is a close-up top view of the hinge portion of the fastener tool of the present invention in the configuration shown in FIG. 4.

As best shown in FIGS. 3, 4, and 5, in their hinged arrangement, faceplates 20 and 22 also define a recess 23 by virtue of detents in their respective abutting sides. Recess 23 serves as a positioning device when fastening tool 10 is applied to a corner bead 54 as shown in FIG. 1. In this use configuration, recess 23 engages the bulbous nose of corner bead 54 and serves to guide fastening tool 10 squarely along the length thereof as fastening tool 10 is moved up or down the length of corner bead 54 to obtain multiple attachment points by insertion of multiple fasteners.

Faceplates 20 and 22 also provide apertures 38 and 40 through which barrels 42 and 44 of fastening guns 12 and 14 extend upon final assembly of the fastening tool.

Attached to faceplate 20 and 22 respectively, are bracket pairs 16 and 19 and 17 and 18 which are best seen in FIGS. 3 and 4. Attachment of these devices which serve for the attachment of guns 12 and 14 and handle 24 is by any suitable means. For example, brackets 16, 17, 18, and 19 can be welded to the rear of face plates 20 and 22, if the materials of construction are appropriate, or simply attached by means of flat head screws which penetrate faceplates 20 and 22 from the front side and engage threaded holes in the brackets. Whatever the means of joining the brackets to the faceplates, the joint must be such as to provide the required rigidity and durability that a tool of this type will require in normal construction usage, while not interfering with the flatness of that side of faceplates 20 and 22 which contacts the corner bead/drywall surface in use.

According to the preferred embodiment depicted and described herein, bracket pairs 16 and 19 and 17 and 18 are designed to engage the slots 62 and 64 provided by the fastener loading mechanisms 66 and 68 in guns 12 and 14. Although it is anticipated that any number of different types of fasteners including nails, staples etc. can be used, it is preferred that the fastener utilized is a staple, as this is the most commonly used fastener for this purpose, and that guns 12 and 14 be pneumatically operated staple guns which eject one-half to one inch staples for securing the corner bead. Most such guns provide loading of the staples at the base of the gun through a sliding arrangement and hence concomitantly provide, on both sides of the gun, a slot for engagement of bracket pairs 16 and 19 and 17 and 18. The preferred manufacturer for such guns is Porta-cable Corporation, 4825 Highway North, Jackson, Tenn. 38302-2468. This company's Narrow Crown Stapler, Model NS 100 is that depicted in the various drawings.

As shown in FIGS. 1–5, and most clearly in FIGS. 3–5, flanges 70 on brackets 16 and 17 engage slots 62 and 64 in gun loading devices 72 and 74 on guns 12 and 14 respectively. A similar arrangement is used for the attachment of brackets 18 and 19 to the lower end of loading devices 72 and 74. Securing of the guns to the brackets through engagement of flanges 70 in slots 62 and 64 can be achieved in any number of ways which will be well known to the skilled artisan and are therefore not specifically shown. A preferred mode of attachment calls for the use of an allen head set screw in the bracket which engages loading device 72 or 74 when tightened, thereby firmly attaching the gun to the bracket and in turn the faceplate.

Pneumatically operated guns 12 and 14 include as a part of barrels 42 and 44 spring loaded safety devices which require that the barrels be firmly against a surface, in fact depressing the safety device, before the gun can be operated. In use, when such depression occurs, the end of barrels 42 and 44 will be in coplanar relationship with the front surfaces of faceplates 20 and 22.

Handle 24 is secured to faceplates 20 and 22 and guns 12 and 14 by means of set screws 46 and 48 which engage threads in brackets 16 and 17 through slots 50 and 52 in handle 24. When set screws 46 and 48 are loosened they permit rotation of faceplates 20 and 22 about the pivot point 61 of hinge 60 by sliding in or out in slots 50 and 52. In fact, each of faceplates 20 and 22 can be adjusted to a different angle relative to handle 24 as shown in FIG. 5, for application to corners which might have a bulge on one side thereof. In the instance shown in FIG. 5, faceplate 22 is basically parallel to surface 25 of handle 24, while faceplate 20 forms an obtuse angle with surface 27 of handle 24.

The grip portion 29 of handle 24 is, of course vertical and generally parallel to face plates 20 and 22 and the vertical axes of guns 12 and 14. The upper or connecting portion 31 of handle 24 is angled away from brackets 16 and 17 so as to permit gripping of handle 24 without interference.

Trigger mechanism 26 generally comprises a bent or formed solid piece of metal or other rigid material 76 which extends from trigger 78 on gun 12 to trigger 80 on gun 14 through handle 24. Lever portion 82 of trigger mechanism 26 is attached to solid piece 76 outside of handle 24 and includes a generally vertical trigger 28, readily engageable with the finger when grip portion 29 is held in the hand, such that pressure applied to trigger 28 is transmitted by rotation of solid piece 76 to triggers 78 and 80 simultaneously thereby providing simultaneous firing of both guns 12 and 14 with the application of pressure to single trigger 28. Solid piece 76 must be free to rotate within handle 24 and bent such that it engages both triggers 78 and 80 throughout the entire rotational capability of hinge 60 when the guns 12 and 14 are attached.

As mentioned hereinabove, manifold 30 is provided at the base of handle 24 to provide distribution of the gun powering fluid, be it air, oil or other, to both guns 12 and 14 simultaneously. Fluid enters inlet port 32 and is evenly so distributed in manifold 30. From manifold 30 the fluid is transmitted to guns 12 and 14 via hoses 34 and 36. As a general rule, hoses 34 and 36 will be quarter inch semi-rigid plastic capable of containing about 200 pounds of internal pressure. The use of such semi-rigid hose has an added advantage in that when configured in this fashion hoses 34 and 36 serve almost as a pair of springs which force the guns together about pivot point 61 of hinge 60. Thus, on application of the fastening tool to the corner of a wall as shown in FIG. 1, guns 12 and 14 must in effect be pried apart to properly engage recess 27 with the bulbous nose of the corner bead, and to bring faceplates 20 and 22 into contact with walls 56 and 58 thereby assuring that the above described required depression of the end of barrels 42 and 44 is achieved to permit firing.

In use, fastening tool 10 is gripped in both hands by guns 12 and 14 and applied to a corner bead as shown in FIG. 1. Pressure is then applied to the guns to assure a tight and close fit of faceplates 20 and 22 against walls 56 and 58 and the depression of the ends of barrels 42 and 44 to permit firing of guns 12 and 14. Set screws 46 and 48 are then tightened using one hand while the other is used to hold fastening tool 10 in place. Fastening tool 10 is then gripped by handle 24 at grip portion 29 and slid up and down corner bead 54 with one hand with the appropriate number of fasteners being applied through compression of trigger 28. If the abovedescribed spring force applied by hoses 34 and 36 is adequate, it may not be necessary to tighten set screws 46 and 48 before beginning the fastening operation.

Although the invention has been described in connection with specific forms and embodiments thereof, it will be understood that various modifications may be resorted to without departing from the spirit and scope of the invention which is intended to be limited only by the scope of the appended claims.

What is claimed is:

1. A corner bead fastening tool comprising: a pair of hinged faceplates forming a faceplate assembly, a pair of fastener guns each mounted on one of the faceplates with brackets, a handle mounted on the faceplate assembly between the fastener guns, and a common trigger mechanism which permits simultaneous firing of both fastener guns.

2. The corner bead fastening tool of claim 1 wherein the handle includes a manifold for conducting a powering fluid in equal amounts to each of the pair of fastener guns.

3. The corner bead fastening tool of claim 2 wherein each of the fastener guns includes a barrel and further including apertures in the hinged faceplates through which the barrels extend.

4. The corner bead fastening tool of claim 1 including on the handle adjustable set screws which permit the hinged faceplates to be locked or placed in fixed angular relationship with one another.

5. The corner bead fastening tool of claim 1 wherein the faceplate assembly includes a pivot point and further including a recess adjacent the pivot point, the recess being designed to engage the bulbous nose of corner bead during use.

6. The corner bead fastening tool of claim 1 wherein each of the fastener guns includes a trigger for activation thereof and the trigger mechanism comprises a bent solid member extending from contact with the trigger of one of the fastener guns to contact with the trigger of the other fastener gun through the handle, a lever portion attached to the solid member on opposite sides either side of the handle and a generally vertical trigger member readily engageable with the finger when the handle is held in the hand, designed such that pressure applied to the generally vertical trigger member is transmitted equally and instantaneously to each of the fastener gun triggers thereby causing simultaneous activation of both fastener guns, the solid member being bent such that it maintains functional proximity to both of the fastener gun triggers throughout the useful field of rotation of the hinged faceplates.

7. The corner bead fastening tool of claim 6 wherein the fastener guns include fastener loading devices at a base thereof which provide slots on opposite sides of the base of the fastener guns and the brackets include flanges which are inserted into the slots on opposite sides of the base of the fastener guns to attach the fastener guns to the faceplate assembly.

* * * * *